US010281835B2

(12) United States Patent
Fuyuno

(10) Patent No.: US 10,281,835 B2
(45) Date of Patent: May 7, 2019

(54) EXPOSURE DEVICE AND IMAGE FORMATION APPARATUS HAVING CUT FRINGE HOLDING MEMBER

(71) Applicant: Oki Data Corporation, Tokyo (JP)

(72) Inventor: Satoshi Fuyuno, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/815,768

(22) Filed: Nov. 17, 2017

(65) Prior Publication Data

US 2018/0149995 A1 May 31, 2018

(30) Foreign Application Priority Data

Nov. 29, 2016 (JP) ..... 2016-230722

(51) Int. Cl.
*G03G 15/01* (2006.01)
*G03G 15/04* (2006.01)
(Continued)

(52) U.S. Cl.
CPC ... *G03G 15/04054* (2013.01); *G03G 15/0435* (2013.01); *G03G 15/011* (2013.01); *G03G 15/04* (2013.01); *G03G 15/04036* (2013.01); *G03G 15/04063* (2013.01); *G03G 15/04072* (2013.01); *G03G 21/1666* (2013.01); *G03G 2215/0402* (2013.01); *G03G 2215/0404* (2013.01); *G03G 2215/0407* (2013.01); *G03G 2215/0409* (2013.01); *G03G 2215/0412* (2013.01);
(Continued)

(58) Field of Classification Search
CPC ..... G03G 15/011; G03G 15/04; G03G 15/04036; G03G 15/04045; G03G 15/04054; G03G 15/04063; G03G 15/04072; G03G 15/0435; G03G 15/0436; G03G 21/1666; G03G 2215/0402; G03G 2215/0404; G03G 2215/0407; G03G 2215/0409; G03G 2215/0412; G03G 2215/0414; G03G 2221/1636
See application file for complete search history.

(56) References Cited

U.S. PATENT DOCUMENTS 9,091,957 B1 * 7/2015 Matsuo ..... G03G 15/0435
2010/0020301 A1 * 1/2010 Sugiyama ..... B41J 2/45 355/67
(Continued)

FOREIGN PATENT DOCUMENTS

JP 2009-073041 A 4/2009
JP 4450848 B2 4/2010

*Primary Examiner* — Joseph S Wong
(74) *Attorney, Agent, or Firm* — Metrolexis Law Group, PLLC

(57) ABSTRACT

An exposure device according to an embodiment includes: a substrate in which light-emitting elements are mounted; an optical system which converges light emitted from the light-emitting elements; a holding member includes a holding member body which holds the substrate and the optical system, and a cut fringe projected from the holding member body; and a support member provided at a predetermined position in the holding member between the substrate and the optical system. The support member is formed of a cured agent attached to a shear surface of the cut fringe of the holding member, and the support member includes a contact surface with which the substrate is in contact.

19 Claims, 7 Drawing Sheets

(51) Int. Cl.
*G03G 15/043* (2006.01)
*G03G 21/16* (2006.01)

(52) U.S. Cl.
CPC ..... *G03G 2215/0414* (2013.01); *G03G 2221/1636* (2013.01)

(56) References Cited

U.S. PATENT DOCUMENTS

2016/0375699 A1* 12/2016 Yamamura ..... B41J 2/45
347/258
2018/0004118 A1* 1/2018 Kasuya ..... G03G 15/04036

* cited by examiner

EXPOSURE DEVICE AND IMAGE FORMATION APPARATUS HAVING CUT FRINGE HOLDING MEMBER

CROSS REFERENCE TO RELATED APPLICATIONS

This application claims priority based on 35 USC 119 from prior Japanese Patent Application No. 2016-230722 filed on Nov. 29, 2016, entitled "EXPOSURE DEVICE AND IMAGE FORMATION APPARATUS", the entire contents of which are incorporated herein by reference.

BACKGROUND

The present disclosure relates to an exposure device and an image formation apparatus.

In related art, an image formation apparatus such as a printer, a photocopier, a facsimile, and a multi-function printer, for example an electrophotographic printer is provided with an image formation unit. The image formation unit is provided with a photosensitive drum, a charge roller, a development roller, and the like. An LED head as an exposure device exposes to light a surface of the photosensitive drum uniformly charged by the charge roller thereby to form an electrostatic latent image. The electrostatic latent image is developed with toner supplied from a toner cartridge, thereby forming a toner image. The toner image is transferred by a transfer roller onto a sheet and is fused by a fuser. In this way, an image is formed.

The LED head includes, for example: an LED array including LEDs; a substrate mounted with the LED array; a holder which holds the substrate; a rod lens array which is installed to the holder while facing the LED array, which converges light emitted from the LEDs of the LED array, and which produces an image at an image producing position on the surface of the photosensitive drum; and a base which keeps the substrate in contact with a contact surface of the holder.

When the LED array is driven, light is emitted from each of the LEDs. The rod lens array converges the emitted light and produces an image at the image producing position on the surface of the photosensitive drum, thereby exposing the surface of the photosensitive drum to light. As a result, an electrostatic latent image is formed (for example, Patent Document 1: Japanese Patent No. 4450848).

Here, in the printer described above, it is necessary to precisely position the substrate relative to the holder in order to precisely expose the surface of the photosensitive drum to light.

To this end, the holder is manufactured using die cast aluminum. The contact surface of the holder to be brought into contact with the substrate is machined to have a flatness of about 20 [μm].

SUMMARY

In the LED head described above, however, it is necessary to manufacture the holder using die cast aluminum and to machine the contact surface, which requires not only complex work for manufacturing the LED head but also a high cost of the LED head.

An embodiment provides an exposure device and an image formation apparatus which make it possible to simplify the work for manufacturing the exposure device and to reduce the cost.

An aspect is an exposure device that includes: a substrate in which light-emitting elements are mounted; an optical system which converges light emitted from the light-emitting elements; a holding member includes a holding member body which holds the substrate and the optical system, and a cut fringe projected from the holding member body; and a support member provided at a predetermined position in the holding member between the substrate and the optical system. The support member is formed of a cured agent attached to a shear surface of the cut fringe of the holding member, and the support member includes a contact surface with which the substrate is in contact.

According to the aspect described above, it is possible to precisely position the substrate relative to the holding member because: the support member formed by curing a curing agent is provided at the predetermined position in the holding member between the substrate and the optical system; and the substrate is brought into contact with the contact surface formed on the support member.

Thus, since it is unnecessary to machine the contact surface, it is possible to simplify the work for manufacturing the exposure device and to reduce the cost of the exposure device.

DETAILED DESCRIPTION

Figure 1:
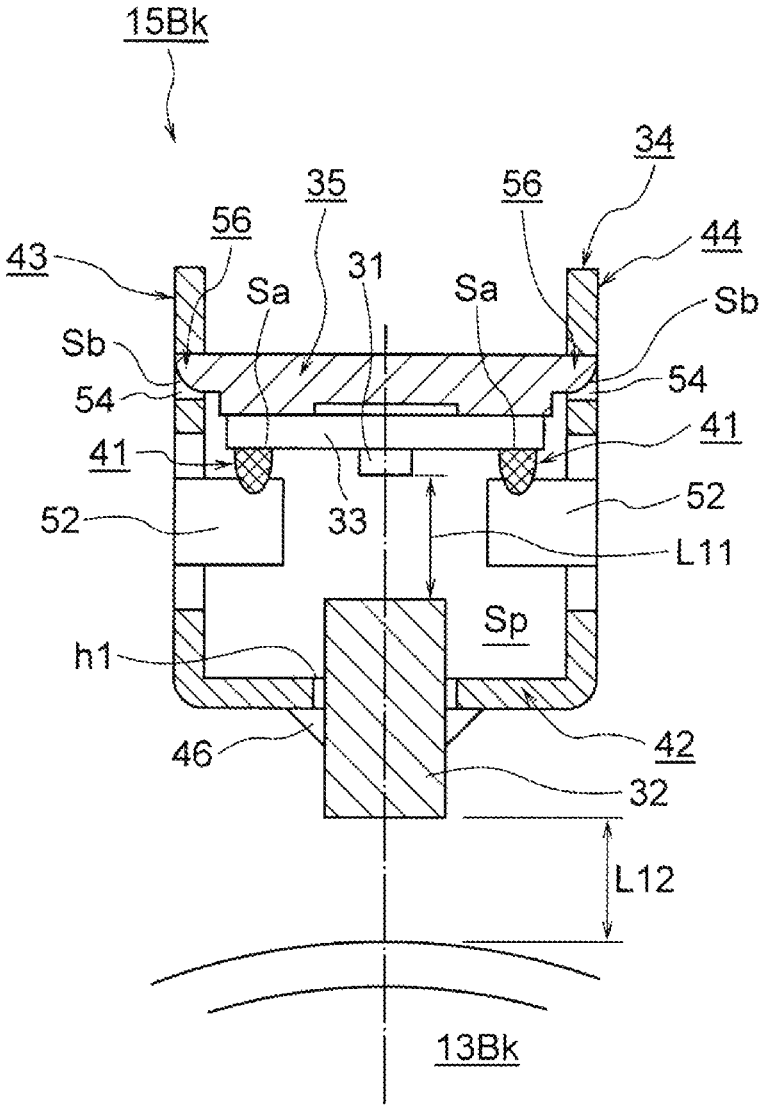
FIG. 1 is a transverse sectional view of an LED head according to a first embodiment.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

Hereinafter, embodiments are described in detail with reference to the drawings. In this case, description is provided for a printer as an image formation apparatus and an LED head as an exposure device provided in the printer.

Figure 2:
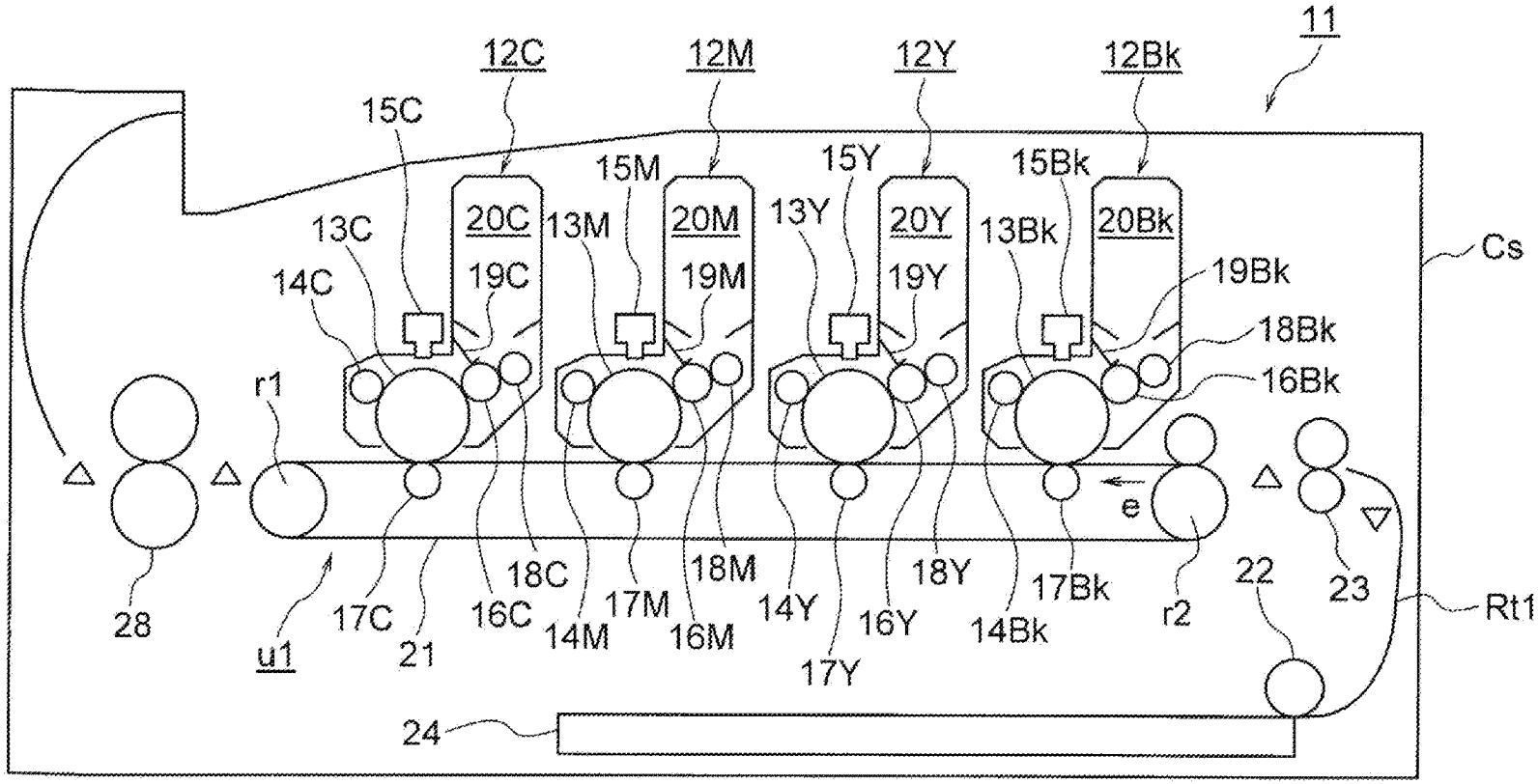
FIG. 2 is a conceptual diagram of a printer according to one or more embodiments.

FIG. 2 is a conceptual diagram of a printer according to one or more embodiments.

In the figure, the reference numeral 11 is the printer, the reference numeral Cs is the housing of the printer 11, the reference numerals 12Bk, 12Y, 12M, and 12C are image formation units of black, yellow, magenta, and cyan colors, respectively, the reference numeral u1 is a transfer unit provided below the image formation units 12Bk, 12Y, 12M, and 12C in the main body of the printer 11, in other words, the device main body, the reference numerals 15Bk, 15Y, 15M, and 15C are LED heads, the reference numeral 24 is a sheet cassette as a media storage unit which is provided below the transfer unit u1 in the device main body and which stores not-illustrated sheets as the media, and the reference numeral 28 is a fuser as a fusing device which is provided downstream of the image formation units 12Bk, 12Y, 12M, and 12C in a transport direction of the sheets.

The image formation units 12Bk, 12Y, 12M, and 12C include, for example: photosensitive drums 13Bk, 13Y, 13M, and 13C which are rotatably provided as image carriers; charge rollers 14Bk, 14Y, 14M, and 14C as charge devices which are rotatably provided in contact with the photosensitive drums 13Bk, 13Y, 13M, and 13C, respectively; development rollers 16Bk, 16Y, 16M, and 16C as developer carriers which are rotatably provided in contact with the photosensitive drums 13Bk, 13Y, 13M, and 13C, respectively; toner supply rollers 18Bk, 18Y, 18M, and 18C as developer supply members which are rotatably provide in press contact with the development rollers 16Bk, 16Y, 16M, and 16C; development blades 19Bk, 19Y, 19M, and 19C as developer limiting members which are provided in press contact with the development rollers 16Bk, 16Y, 16M, and 16C; and toner cartridges 20Bk, 20Y, 20M, and 20C as developer containers which are provided above the toner supply rollers 18Bk, 18Y, 18M, and 18C and which store toner as the developers of the four colors.

Moreover, the LED heads 15Bk, 15Y, 15M, and 15C are provided above the photosensitive drums 13Bk, 13Y, 13M, and 13C of the image formation units 12Bk, 12Y, 12M, and 12C to face the photosensitive drums 13Bk, 13Y, 13M, and 13C, respectively.

In the image formation units 12Bk, 12Y, 12M, and 12C, the charge rollers 14Bk, 14Y, 14M, and 14C are rotated when the photosensitive drums 13Bk, 13Y, 13M, and 13C are rotated. As a result, the surfaces of the photosensitive drums 13Bk, 13Y, 13M, and 13C are uniformly charged. Then, the LED heads 15Bk, 15Y, 15M, and 15C expose the surfaces of the photosensitive drums 13Bk, 13Y, 13M, and 13C to light in accordance with the image data of the four colors. Thus, an electrostatic latent image as a latent image is formed.

In addition, the development rollers 16Bk, 16Y, 16M, and 16C and the toner supply rollers 18Bk, 18Y, 18M, and 18C are rotated when the photosensitive drums 13Bk, 13Y, 13M, and 13C are rotated. Then, the toner supplied from the toner cartridges 20Bk, 20Y, 20M, and 20C is supplied by the toner supply rollers 18Bk, 18Y, 18M, and 18C to the development rollers 16Bk, 16Y, 16M, and 16C. As a result, a thin layer is created on each of the development rollers 16Bk, 16Y, 16M, and 16C by the development blades 19Bk, 19Y, 19M, and 19C, thus forming a toner layer.

Thereafter, the toner on the development rollers 16Bk, 16Y, 16M, and 16C adheres to the electrostatic latent images, and toner images as developer images of the four colors are formed on the photosensitive drums 13Bk, 13Y, 13M, and 13C.

The transfer unit u1 includes: a drive roller r1 as a first roller; a driven roller r2 as a second roller; a transfer belt 21 as a transport member which is stretched such that the drive roller r1 and the driven roller r2 allow the transfer belt 21 to travel in the direction of arrow e; and transfer rollers 17Bk, 17Y, 17M, and 17C as transfer members which are provided to face the photosensitive drums 13Bk, 13Y, 13M, and 13C with the transfer belt 21 in between, which charge the sheet to the polarity opposite to that of the toner, and which transfer the toner images of the four colors onto the sheet.

In the printer 11 of the above configuration, when a hopping roller 22 as a delivery member provided at a front end of the sheet cassette 24 is rotated, the sheet delivered from the sheet cassette 24 to a media transport unit Rt1 is sent to a registration roller 23. After the registration roller 23 corrects the skew, the sheet is transported along with the movement of the transfer belt 21, and is then sent to between the photosensitive drums 13Bk, 13Y, 13M, and 13C and the transfer rollers 17Bk, 17Y, 17M, and 17C. Here, the toner images of the four colors are sequentially transferred onto the sheet, and thus a color toner image is formed on the sheet.

Subsequently, the sheet is sent to the fuser 28. At the fuser 28, the color toner image is fused on the sheet by heating and pressing, thus forming a color image on the sheet. The sheet subjected to such printing is discharged by a not-illustrated sheet discharge roller to the outside of the device main body.

Note that after the transfer of the toner images of the four colors is finished, the toner remaining on the photosensitive drums 13Bk, 13Y, 13M, and 13C is scraped off and removed by not-illustrated cleaning members.

Next, the LED heads 15Bk, 15Y, 15M, and 15C are described.

Figure 3:
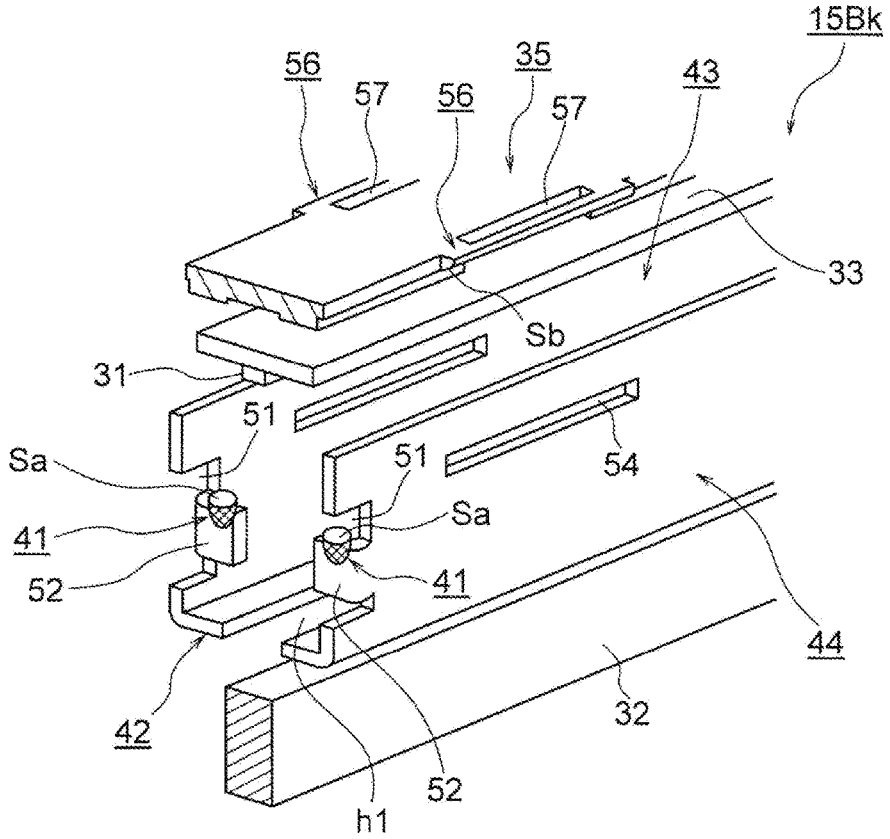
FIG. 3 is an exploded perspective view of the LED head.
Figure 4:
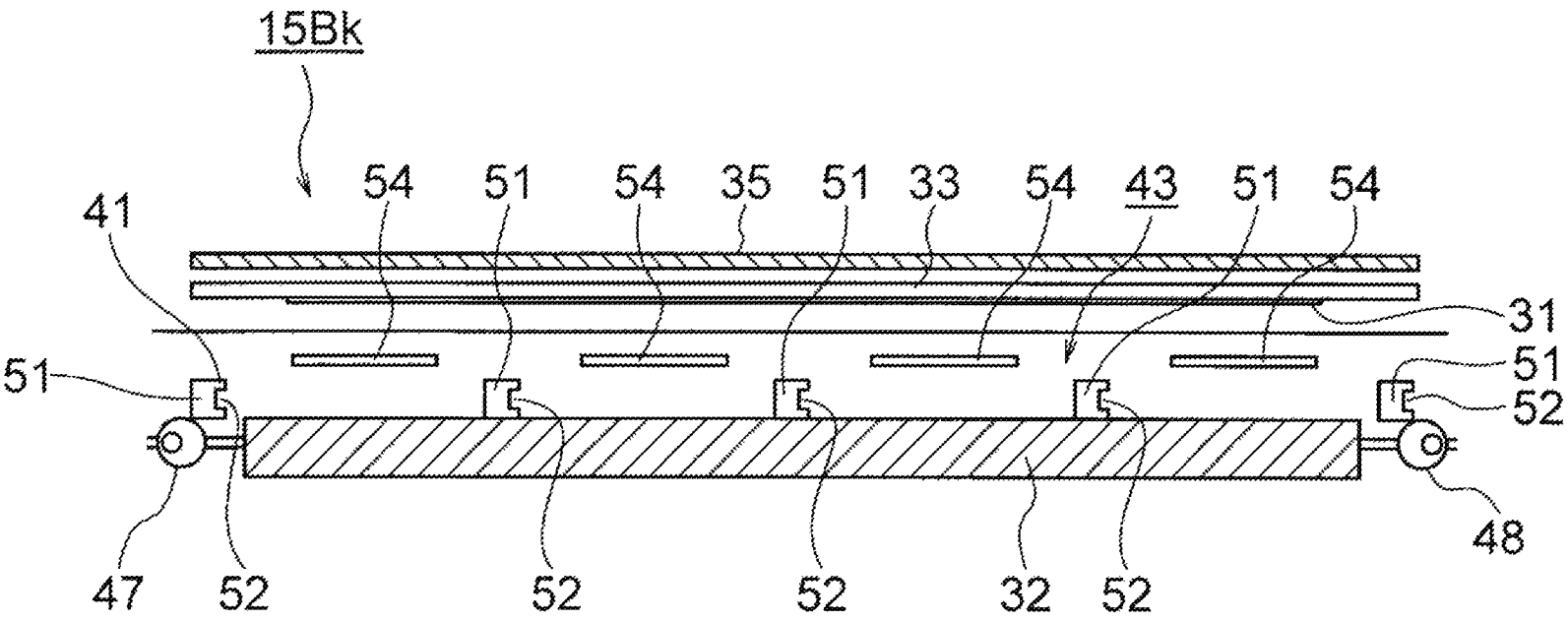
FIG. 4 is an exploded longitudinal sectional view of the LED head.

FIG. 1 is a transverse sectional view of an LED head according to a first embodiment, FIG. 3 is an exploded perspective view of the LED head, and FIG. 4 is an exploded longitudinal sectional view of the LED head. Note that since the LED heads 15Bk, 15Y, 15M, and 15C have the same structure, description is provided only for the LED head 15Bk in the figures.

In the figures, the reference numeral 13Bk is a photosensitive drum, and the reference numeral 15Bk is an LED head which is provided to face the photosensitive drum 13Bk and to extend in a direction of an axis of the photosensitive drum 13Bk.

The LED head 15Bk includes: an LED array 31 as a light-emitting element array including LEDs as light-emitting elements which is provided to extend in the direction of the axis of the photosensitive drum 13Bk; a rod lens array 32 as an optical system and as a converging lens which is provided between the LED array 31 and the photosensitive drum 13Bk to extend in the direction of the axis of the photosensitive drum 13Bk, which has a convergence property, and which converges light emitted from the LEDs, thereby producing an image at the image producing position on the surface of the photosensitive drum 13Bk; a substrate 33 which is mounted with the LEDs of the LED array 31 and a not-illustrated driver IC for controlling the LEDs; a holder 34 as a holding member which holds the rod lens array 32 and the substrate 33; and a base 35 as a press member which is held by the holder 34 and which presses the substrate 33 against the holder 34 to position the substrate 33 relative to the holder 34.

The substrate 33 is made of a reinforced resin material such as a glass epoxy resin. In addition, the base 35 is made of a thermoplastic resin material with elasticity and flexibility, for example, general purpose engineering plastic, such as polyamide reinforced by glass fiber. Use of the general-purpose engineering plastic makes it possible to enhance, for example, the heat resistance and the heat deflection temperature property of the base 35 and to stably maintain the elasticity and the flexibility for a long period.

When image data are sent to the driver IC, the LED array 31 is driven and light is emitted from the LEDs in accordance with the image data. The rod lens array 32 converges the emitted light to produce an image at the image producing position on the surface of the photosensitive drum 13Bk. As a result, the surface of the photosensitive drum 13Bk is exposed to light, thus forming an electrostatic latent image.

Note here that it is necessary to precisely position the substrate 33 relative to the holder 34 in order to precisely expose the surface of the photosensitive drum 13Bk to light.

To this end, in a conventional LED head, the holder 34 is manufactured using die cast aluminum and the contact surface of the holder 34 to be brought into contact with the substrate 33 is machined. Such a case results not only in complex work for manufacturing the LED head 15Bk but also in high cost of the LED head 15Bk.

In light of the above, in an embodiment, the holder 34 is manufactured by pressing (sheet metal processing) a steel plate, for example, a metal plate material, such as a galvanized steel plate. Additionally, in an embodiment, provided at predetermined positions between the substrate 33 and the rod lens array 32 in the holder 34 are intermediate support members 41 as support members formed of a curing agent made of a UV curable resin which cures when receiving ultraviolet rays. A contact surface Sa is formed on each of the intermediate support member 41. The base 35 presses the substrate 33 against the contact surface Sa so that the substrate 33 is in press contact with the contact surface Sa. Thus, the substrate 33 is positioned relative to the holder 34. In this case, the flatness of the contact surface Sa is 100 [μm] or less, and preferably 10 [μm] or less. Incidentally, the flatness is measured with a measuring microscope MF (manufactured by Mitutoyo Corporation).

To this end, the holder 34 is a box-shaped body which includes a bottom plate 42 and side plates 43 and 44 formed in parallel with each other in a way to stand from both edges of the bottom plate 42. Note that when the box-shaped body is closed by the base 35, a space Sp for accommodating the LED array 31 and the substrate 33 is formed.

A slot-shaped hole h1 to hold the rod lens array 32 is formed in the center portion in a width direction of the bottom plate 42 while extending in a longitudinal direction. The rod lens array 32 is installed to the holder 34 in a way to penetrate the hole h1 and to insert almost half in a height direction of the rod lens array 32 into the space Sp. Then, adhesion positions are set at positions in a gap between an inner peripheral surface of the hole h1 and an outer peripheral surface of the rod lens array 32. A not-illustrated adhesive is provided at the adhesion positions. The holder 34 and the rod lens array 32 are glued together with the adhesive and are fixed together. After that, silicone 46 as a sealant is further provided into the gap between the inner peripheral surface of the hole h1 and the outer peripheral surface of the rod lens array 32. The silicone 46 seals the gap between the holder 34 and the rod lens array 32.

Besides, cutout portions 51 are formed at a regular pitch by cutting out the plate material at predetermined positions in the holder 34 between the substrate 33 and the rod lens array 32, or in the embodiment, at the center in a height direction of the side plates 43 and 44 and at positions in the longitudinal direction of the side plates 43 and 44. Additionally, substrate upholders 52 protruding inward of the space Sp and facing each other are formed at the center portions in a height direction of the cutout portions 51.

The cutout portions 51 and the substrate upholders 52 have rectangular shapes. The substrate upholder 52 is formed by bending a portion of the cut fringe formed at the formation of the cutout portion 51, inward of the space Sp about an axis extending in a height direction of the holder 34, and thus the substrate upholder 52 is rigid. That is, the cut fringes serving as the substrate upholders 52 protrude from a body of the holder 34 serving as a holding member body and is bent inwardly.

Then, the intermediate support member 41 is provided on an edge portion of each substrate upholder 52, in other words, on a shear surface or a cut surface of the cut fringe formed at the formation of each cutout portion 51. The intermediate support member 41 is formed in a way to cover a portion of the substrate upholder 52. The contact surface Sa to be brought into contact with the substrate 33 is formed on an upper surface of the intermediate support member 41.

With the substrate 33 mounted on the intermediate support members 41, and the base 35 on the substrate 33, installing the base 35 to the holder 34 positions the substrate 33 relative to the holder 34 with the substrate 33 pressed against the contact surface Sa.

For this purpose, near the upper edges of the side plates 43 and 44, the cutout portions 51 are formed at a regular pitch at positions in the longitudinal direction of the side plates 43 and 44, and slots 54 as first engagement portions are formed to extend in the longitudinal direction at the centers between two cutout portions 51. In addition, projecting portions 56 as second engagement portions are formed at positions in the longitudinal direction of both edges of the base 35 in a way to protrude corresponding to the slots 54. A slit 57 is formed in each of the projecting portions 56 in a way to extend in the longitudinal direction so that the projecting portion 56 can be deformed. A tapering surface Sb is formed on the lower surface of the projecting portion 56 such that the thickness of the projecting portion decreases toward the distal end.

The substrate 33 is mounted on the intermediate support members 41 and then the projecting portions 56 are placed in contact with the upper edges of the plates 43 and 44 of the holder 34. After that, when the base 35 is pressed downward, the base 35 enters the holder 34 and is mounted on the substrate 33. Here, the projecting portion 56 is deformed with the tapering surface Sb sliding on the upper edge of each of the side plates 43 and 44. When the base 35 is mounted on the substrate 33, the projecting portion 56 reaches the position where the projecting portion 56 faces the slot 54, is restored to the original shape, and enters the slot 54. In such a manner, the slot 54 and the projecting portion 56 engage with each other.

Note that in order to precisely produce an image on the photosensitive drum 13Bk, it is necessary to adjust the position of the rod lens array 32 so that the distances L11 and L12 satisfy $$L11=L12,$$

where L11 is the distance between the surface of the LEDs of the LED array 31 (light emitting surface) and the end surface of the rod lens array 32 on which the light is incident, in other words, the incident end surface (gap between the LED array 31 and the rod lens array 32), and L12 is the distance between the end surface of the rod lens array 32 from which the light is emitted, in other words, the emission end surface and the surface of the photosensitive drum 13Bk (gap between the rod lens array 32 and the photosensitive drum 13Bk).

To this end, eccentric cams 47 and 48 as adjusting members are provided near the end portions in the longitudinal direction of the holder 34. A cam surface of each of the eccentric cams 47 and 48 and a contact surface of a not-illustrated spacer provided on the photosensitive drum 13Bk come into contact with each other. Thus, rotation of the eccentric cams 47 and 48 makes it possible to move the holder 34 in the height direction and to adjust the position of the rod lens array 32 relative to the photosensitive drum 13Bk.

Note that not-illustrated coil springs as biasing members are provided at both end portions of the base 35. The coil springs maintain the distance L12 by biasing the LED head 15Bk toward the photosensitive drum 13Bk and bringing the cam surfaces of the eccentric cams 47 and 48 into contact with the contact surface of the spacer.

Next, a method of forming the intermediate support members 41 on the holder 34 is described.

Figure 5:
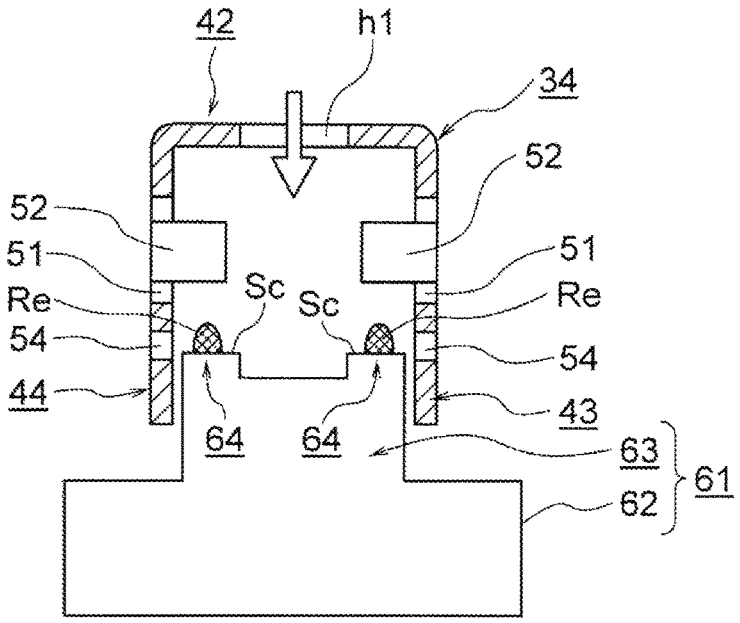
FIG. 5 is a first diagram for explaining a method of forming intermediate support members on a holder according to a first embodiment.
Figure 6:
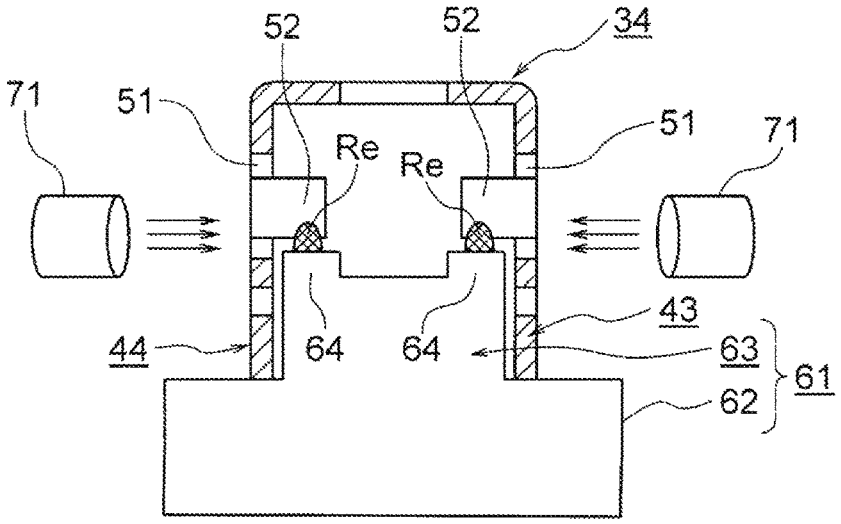
FIG. 6 is a second diagram for explaining the method of forming the intermediate support members on the holder.
Figure 7:
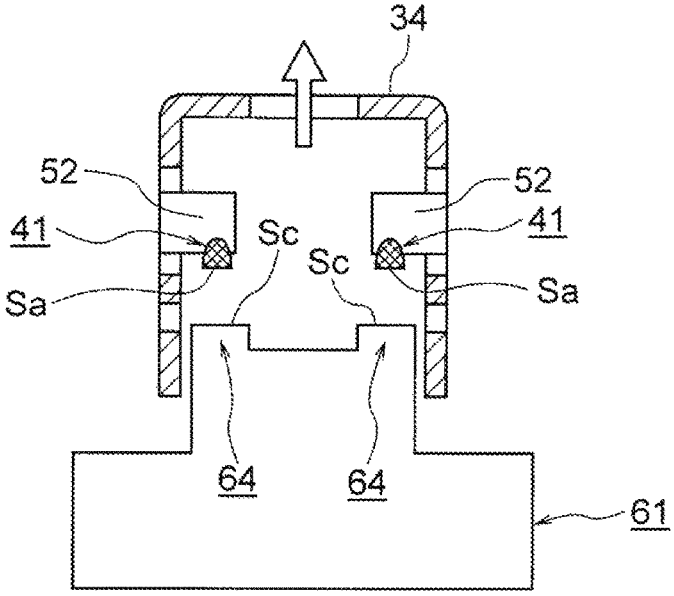
FIG. 7 is a third diagram for explaining the method of forming the intermediate support members on the holder.

FIG. 5 is a first diagram for explaining the method of forming the intermediate support members on the holder according to a first embodiment, FIG. 6 is a second diagram for explaining the method of forming the intermediate support members on the holder, and FIG. 7 is a third diagram for explaining the method of forming the intermediate support members on the holder.

In the figures, the reference numeral 34 is the holder, the reference numeral 61 is a jig, and the reference numeral Re is a curing agent being the material of the intermediate support members 41.

FIG. 5 illustrates the holder 34 manufactured by pressing the metal plate material. At this stage, the intermediate support members 41 are not formed. Note that the pressing forms the hole h1 in the bottom plate 42 of the holder 34, forms the cutout portions 51 and the slots 54 in the side plates 43 and 44, and forms the substrate upholders 52 in the cutout portions 51.

The jig 61 is formed to extend in the longitudinal direction and includes a base portion 62 and a protrusion 63 formed to protrude from the base portion 62. Material drop portions 64 onto which the curing agent Re is dropped are formed to protrude from the protrusion 63 while corresponding to the substrate upholders 52 at more than one position in a width direction of the protrusion 63, or two positions in the embodiment, and at the same time, at more than one position in the longitudinal direction, or five positions in the embodiment.

In the embodiment, the intermediate support members 41 are formed by curing the curing agent Re and the contact surface Sa is formed on each of the intermediate support members 41. For this reason, the flatness of a surface Sc of material drop portions 64 is about 10 [μm]. Note that the surface Sc of the material drop portion 64 is coated with, for example, silicone as a detachment layer so that the curing agent Re will not stick to the material drop portion 64 after the curing agent Re in the embodiment is cured.

The curing agent Re is dropped onto each of the material drop portions 64 in order to form the intermediate support members 41 on the holder 34 and to form the contact surface Sa on each of the intermediate support members 41. When the holder 34 is moved down in the arrow direction inverted with the bottom plate 42 on the upper side as illustrated in FIG. 5, the protrusion 63 enters the holder 34 and each material drop portion 64 is opposed to the corresponding substrate upholder 52.

Then, when the holder 34 is placed on the jig 61 so that the tip ends of the side plates 43 and 44 are placed to come into contact with the base portion 62 as illustrated in FIG. 6, a gap with a certain width is formed between each material drop portion 64 and the corresponding substrate upholder 52. The curing agent Re on the material drop portion 64 is pressed against the substrate upholder 52, and surrounds and adheres to a portion of the substrate upholder 52.

Subsequently, ultraviolet ray emitters 71 as cure acceleration devices emit ultraviolet rays as cure acceleration media from both sides of the holder 34 through the cutout portions 51 toward the curing agent Re in order to cure the curing agent Re adhering to the substrate upholder 52.

In such a manner, when the curing agent Re is cured, the holder 34 is moved up in the arrow direction and is lifted up from the jig 61, as illustrated in FIG. 7. Thus, the cured curing agent Re is detached from the material drop portions 64 to form the intermediate support member 41. Then, the surface Sc of the material drop portion 64 is transferred onto the intermediate support member 41, thereby forming the contact surface Sa.

In an embodiment, the UV curable resin which cures when receiving ultraviolet rays is used as the curing agent Re and the ultraviolet ray emitters 71 as cure acceleration devices emit ultraviolet rays as the cure acceleration media. Note that it is also possible to use as the curing agent Re, for example, a resin which cures by being heated, a resin which cures by being added with a cure acceleration agent, or a resin which cures with time. For instance, if the resin which cures by being heated is used as the curing agent Re, it is possible to form the intermediate support members 41 by causing an infrared ray emitter as the cure acceleration device to emit infrared rays as the cure acceleration media.

When the intermediate support members 41 are formed on the holder 34, a not-illustrated jig installs the rod lens array 32 to the holder 34 with the contact surfaces Sa of the intermediate support members 41 as the reference so that the distances L11 and L12 when the substrate 33 (FIG. 1) is installed to the holder 34 are equal to each other. In such a manner, the LED head 15Bk is manufactured.

As described above, each of the intermediate support members 41 formed by curing the curing agent Re is provided at a predetermined position in the holder 34 between the substrate 33 and the rod lens array 32, and the substrate 33 comes into contact with the contact surfaces Sa formed on the intermediate support members 41. Hence, it is possible to precisely position the substrate 33 relative to the holder 34.

In addition, since it is unnecessary to machine the contact surfaces Sa, it is possible to simplify the work for manufacturing the LED heads 15Bk, 15Y, 15M, and 15C. As a result, it is possible to reduce the costs of the LED heads 15Bk, 15Y, 15M, and 15C.

Moreover, since it is unnecessary to bring the substrate 33 into direct contact with the member with conductivity such as the holder 34, it is unnecessary to form a resist layer for insulating the substrate 33 on the surface of the substrate 33. Thus, it is possible to reduce the cost of the substrate 33.

Furthermore, since the curing agent Re is pressed against the edge portion of each of the substrate upholders 52, it is possible to suppress the deformation of the curing agent Re. Thus, it is possible to reduce the contact surface Sa in size and to downsize the LED heads 15Bk, 15Y, 15M, and 15C.

The cutout portion 51 is formed in each of the side plates 43 and 44 and the substrate upholder 52 is formed in the cutout portion 51. Note however that it is sometimes necessary to reduce the distance between the hole h1 and the cutout portion 51 because of e.g. the different dimensions and formation positions of the substrate upholder 52 depending on the type and the structure of the LED heads 15Bk, 15Y, 15M, and 15C. In that case, the strength of the holder 34 decreases.

Considering the above, it is conceivable to reduce the gap between the inner peripheral surface of the hole h1 and the outer peripheral surface of the rod lens array 32 by reducing the width of the hole h1, and accordingly to increase the distance between the hole h1 and the cutout portion 51.

However, the amount of the gap is set such that when, for example, a predetermined amount of adhesive is provided at each adhesion position, the adhesive sufficiently reaches the backside of the holder 34 and that adhesion strength between the holder 34 and the rod lens array 32 is secured. For this reason, if the gap is small, the adhesive does not sufficiently reach the backside of the holder 34 and thus it is impossible to secure adhesion strength between the holder 34 and the rod lens array 32.

Next, description is provided for a second embodiment which makes it possible to secure adhesion strength between the holder 34 and the rod lens array 32 even when the gap is small between the inner peripheral surface of the hole h1 and the outer peripheral surface of the rod lens array 32. Note that the elements with the same structure as in the first embodiment are assigned the same reference numerals and the effects of the first embodiment are referred to for the effects resulting from the same structure.

Figure 8:
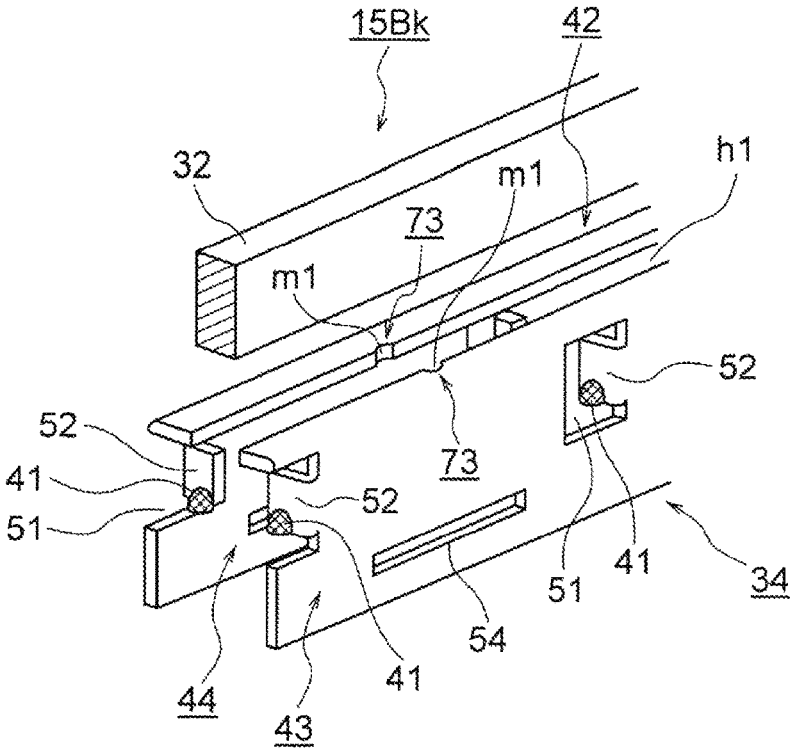
FIG. 8 is an exploded perspective view illustrating main parts of an LED head according to a second embodiment.

FIG. 8 is an exploded perspective view of illustrating main parts of an LED head according to a second embodiment.

In this case, a groove 73 as a gap widening portion is formed at each of the adhesion positions set on the bottom plate 42 in the longitudinal direction. The grooves 73 are formed by forming recessed portions m1 with the shape of a semicircle to face each other in the surface of the bottom plate 42 where the hole h1 is formed.

Since the grooves 73 are formed, the gap at each adhesion position is increased between the inner peripheral surface of the hole h1 and the outer peripheral surface of the rod lens array 32 as an optical system and as a converging lens. Thus, since the adhesive sufficiently reaches the backside of the holder 34 through the groove 73, it is possible to secure adhesion strength between the holder 34 and the rod lens array 32.

If the grooves 73 is formed at a portion in the longitudinal direction of the holder 34 where the cutout portion 51 is formed, the distance between the hole h1 and the cutout portion 51 is reduced by the amount corresponding to the grooves 73, and the strength of the holder 34 decreases accordingly. In light of this, in the embodiment, the grooves 73 are formed such that the grooves 73 are not located at the cut fringes forming the substrate upholders 52 in the longitudinal direction of the holder 34 or, in the embodiment, formed at the centers between two adjacent cutout portions 51 in the longitudinal direction of the holder 34, i.e., at portions where the slots 54 are formed.

Additionally, the grooves 73 are formed such that they are opposed to each other. Instead, the grooves 73 may be formed such that they are not opposed to each other.

Here, in the first and second embodiments, each of the substrate upholders 52 formed in the cutout portions 51 has a rectangular shape and the edge portion of the substrate upholder 52 on which the intermediate support member 41 is formed is flat. For this reason, it is impossible to sufficiently increase the contact area between the curing agent Re and the substrate upholder 52 when the curing agent Re dropped onto the material drop portion 64 is pressed against the substrate upholder 52. Therefore, it is impossible to form the intermediate support member 41 on the substrate upholder 52 sufficiently stably. In view of the above, description is provided for a third embodiment which makes it possible to form the intermediate support member 41 on the substrate upholder 52 sufficiently stably. Note that the elements with the same structure as in the first and second embodiments are assigned the same reference numerals and the effects of the first and second embodiments are referred to for the effects resulting from the same structure.

Figure 9:
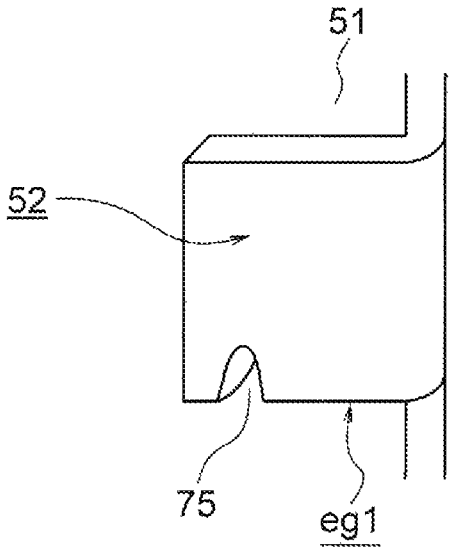
FIG. 9 is a perspective view illustrating a main part of a holder according to a third embodiment.

FIG. 9 is a perspective view illustrating a main part of a holder according to a third embodiment.

In this case, a notch portion 75 is formed in the edge portion eg1 of the cut fringe forming the substrate upholder 52, on the side where the intermediate support member 41 (FIG. 1) as a support member is formed. Since this makes it possible to sufficiently increase the contact area between the curing agent Re and the substrate upholder 52 when the curing agent Re dropped onto the material drop portion 64 (FIG. 5) is pressed against the substrate upholder 52, it is possible to form the intermediate support member 41 on the substrate upholder 52 sufficiently stably.

In the embodiments, the holder 34 is manufactured by pressing a metal plate material such as a galvanized steel plate. The holder 34 may be manufactured by machining aluminum, die casting, etc. In that case, the costs of the LED heads 15Bk, 15Y, 15M, and 15C as exposure devices increase due to the machining of aluminum or manufacturing of die cast aluminum. However, the intermediate support member 41 formed with the curing agent Re eliminates the necessity of machining the contact surface Sa, reducing the cost accordingly. Moreover, it is possible to manufacture the holder 34 by injection molding of a resin.

In the embodiments, description is provided for the printer 11. However, the invention is applicable to an image formation apparatus such as a photocopier, a facsimile, and a multi-function printer.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. An exposure device comprising:

a substrate in which light-emitting elements are mounted;

an optical system converging light emitted from the light-emitting elements;

a holding member comprising a holding member body holding the substrate and the optical system, and a cut fringe projected from the holding member body, the holding member being formed by pressing a plate material, and a support member provided at a predetermined position in the holding member between the substrate and the optical system, wherein the cut fringe is formed by cutting out the plate material on a side of the holding member; and the support member comprises a cured agent attached to a shear surface of the cut fringe of the holding member, and a contact surface with which the substrate is in contact.

2. An exposure device comprising:

a substrate in which light-emitting elements are mounted;

an optical system converging light emitted from the light-emitting elements;

a holding member comprising a holding member body holding the substrate and the optical system, and a cut fringe projected from the holding member body; and a support member provided at a predetermined position in the holding member between the substrate and the optical system, wherein the support member comprises a cured agent attached to a shear surface of the cut fringe of the holding member, and a contact surface with which the substrate is in contact, the cut fringe comprises a pair of cut fringes, substrate upholders are formed of the pair of cut fringes bent to face each other, and the support member is formed on each of the substrate upholders.

3. The exposure device according to claim 2, wherein the substrate upholders are rigid.

4. An exposure device according to claim 1, further comprising:

a substrate in which light-emitting elements are mounted;

an optical system converging light emitted from the light-emitting elements;

a holding member comprising a holding member body holding the substrate and the optical system, and a cut fringe projected from the holding member body;

a support member provided at a predetermined position in the holding member between the substrate and the optical system; and a press member which is held by the holding member and which presses the substrate against the support member, wherein the support member comprises a cured agent attached to a shear surface of the cut fringe of the holding member, and a contact surface with which the substrate is in contact.

5. The exposure device according to claim 1, wherein a flatness of the contact surface formed on the support member is 100 μm or less.

6. The exposure device according to claim 1, wherein a bottom plate of the holding member comprises a hole, the hole extending in a longitudinal direction of the holding member and configured to hold the optical system, the holding member and the optical system are glued together with an adhesive provided at adhesion positions set in a gap between an inner peripheral surface of the hole and an outer peripheral surface of the holding member, and, a sealant is provided into the gap between the inner peripheral surface of the hole and the outer peripheral surface of the optical system, and seals the gap between the holding member and the optical system, and the bottom plate comprises a groove at each of the adhesion positions.

7. The exposure device according to claim 6, wherein the groove is formed at a position different from the cut fringe in the longitudinal direction of the holding member.

8. The exposure device according to claim 1, wherein a notch portion comprises an edge portion of the cut fringe, the edge portion being on a side where the support member is provided.

9. An image formation apparatus comprising the exposure device according to claim 1.

10. The exposure device according to claim 2, wherein a flatness of the contact surface of the support member is 100 μm or less.

11. The exposure device according to claim 2, wherein a bottom plate of the holding member comprises a hole, the hole extending in a longitudinal direction of the holding member and configured to hold the optical system, the holding member and the optical system are glued together with an adhesive provided at adhesion positions set in a gap between an inner peripheral surface of the hole and an outer peripheral surface of the holding member, and, a sealant is provided into the gap between the inner peripheral surface of the hole and the outer peripheral surface of the optical system, and seals the gap between the holding member and the optical system, and the bottom plate comprises a groove at each of the adhesion positions.

12. The exposure device according to claim 11, wherein the groove is formed at a position different from the cut fringe in the longitudinal direction of the holding member.

13. The exposure device according to claim 2, wherein the cut fringe comprises an edge portion, the edge portion is provided on a side of the holding member where the support member is provided, and the edge portion comprises a notch portion.

14. An image formation apparatus comprising the exposure device according to claim 2.

15. The exposure device according to claim 4, wherein a flatness of the contact surface formed on the support member is 100 μm or less.

16. The exposure device according to claim 4, wherein a bottom plate of the holding member comprises a hole, the hole extending in a longitudinal direction of the holding member and configured to hold the optical system, the holding member and the optical system are glued together with an adhesive provided at adhesion positions set in a gap between an inner peripheral surface of the hole and an outer peripheral surface of the holding member, and, a sealant is provided into the gap between the inner peripheral surface of the hole and the outer peripheral surface of the optical system, and seals the gap between the holding member and the optical system, and the bottom plate comprises a groove at each of the adhesion positions.

17. The exposure device according to claim 16, wherein the groove is formed at a position different from the cut fringe in the longitudinal direction of the holding member.

18. The exposure device according to claim 4, wherein the cut fringe comprises an edge portion, the edge portion is provided on a side of the holding member where the support member is provided, and the edge portion comprises a notch portion.

19. An image formation apparatus comprising the exposure device according to claim 4.

* * * * *